US010246848B2

(12) United States Patent
Worth

(10) Patent No.: US 10,246,848 B2
(45) Date of Patent: Apr. 2, 2019

(54) UPPER HINGE DESIGN FOR A BUCKET

(71) Applicant: Caterpillar Inc., Peoria, IL (US)

(72) Inventor: David Michael Worth, Naperville, IL (US)

(73) Assignee: Caterpillar Inc., Deerfield, IL (US)

( * ) Notice: Subject to any disclaimer, the term of this patent is extended or adjusted under 35 U.S.C. 154(b) by 631 days.

(21) Appl. No.: 14/992,236

(22) Filed: Jan. 11, 2016

(65) Prior Publication Data

US 2017/0198456 A1 Jul. 13, 2017

(51) Int. Cl.

| | |
|---|---|
| ***E02F 3/40*** | (2006.01) |
| ***E02F 3/34*** | (2006.01) |
| ***E02F 3/36*** | (2006.01) |

(52) U.S. Cl.

CPC ..... *E02F 3/40* (2013.01); *E02F 3/34* (2013.01); *E02F 3/3417* (2013.01); *E02F 3/3631* (2013.01)

(58) Field of Classification Search

CPC ... E02F 3/40; E02F 3/401; E02F 3/407; E02F 3/3622; E02F 3/3668; E02F 3/3672; E02F 3/34; E02F 3/3417; E02F 3/3631

USPC ..... 37/404, 444, 195; 414/722–724

See application file for complete search history.

(56) References Cited

U.S. PATENT DOCUMENTS

| | | | | |
|---|---|---|---|---|
| 1,972,652 | A * | 9/1934 | Gill | E02F 3/40 37/444 |
| 3,860,131 | A | 1/1975 | Borowski et al. | |
| 4,395,193 | A * | 7/1983 | Christensen | E02F 3/401 37/444 |
| 4,523,397 | A * | 6/1985 | Lucas | E02F 3/401 37/444 |
| 4,813,163 | A | 3/1989 | Livingston | |
| 4,939,855 | A * | 7/1990 | McCreary, Jr. | E02F 3/40 37/195 |
| 4,984,957 | A | 1/1991 | Noguchi et al. | |
| 5,599,158 | A | 2/1997 | Ajilore | |
| 7,730,650 | B1 | 6/2010 | Barnhill | |
| 2013/0045073 | A1 | 2/2013 | Bricker et al. | |
| 2017/0138015 | A1* | 5/2017 | Jamilosa | E02F 3/4075 |

FOREIGN PATENT DOCUMENTS

| | | | |
|---|---|---|---|
| CN | 203808124 | U | 9/2014 |
| JP | 2007146547 | A | 6/2007 |

* cited by examiner

*Primary Examiner* — Robert E Pezzuto

(74) *Attorney, Agent, or Firm* — Law Office of Kurt J. Fugman LLC

(57) ABSTRACT

A hinge attachment bracket for use with a work implement is provided. The bracket comprises a substantial I-beam configuration that includes a first flange, a second flange, a web that connects the first flange to the second flange and that defines a boss that defines a pin receiving bore that establishes a radial direction, a radial plane and a longitudinal axis. The first and second flanges may merge toward each other tangentially forming a first extension portion.

20 Claims, 5 Drawing Sheets

UPPER HINGE DESIGN FOR A BUCKET

TECHNICAL FIELD

The present disclosure relates generally to a bucket for moving material such as dirt and the like. More specifically, the present disclosure relates to an improved upper hinge design for a bucket.

BACKGROUND

Buckets for moving dirt and the like are well known in the art. These buckets are typically used by machines in construction, mining, agriculture etc. There are different types of machines that use buckets such as large wheel loaders and that connect to the bucket for controlling its movement in certain ways.

For example, FIG. 1, which is taken from U.S. Pat. No. 8,500,599, shows an outline of a wheel loader as one example for a vehicle or machine 100. In reference to these figures, the vehicle 100 includes an engine frame portion 102 connected to a non-engine frame portion 104 by an articulated joint 106. Each of the engine frame portion 102 and non-engine frame portion 104 includes a respective axle connected to a set of wheels 108. The engine frame portion 102 includes the engine 110 or other motor, which powers the movement of the machine via the wheels while also powering the movement of other accessories of the machine. A cab 130 is also provided where an operator controls the machine.

The vehicle 100 of the illustrated embodiment includes a work implement, which in this case is a bucket 122 connected at the end of a pair of lift arms 114 that are pivotally connected to the non-engine frame portion 104 of the vehicle 100 at hinges 116. Other work implements such as a forklift, shears, etc. may be used.

The bucket 122 is attached to the lift arms 114 at a lower hinge point 112 and an upper hinge point 118. When movement of the bucket is triggered by the operator, the hydraulic cylinder 120 moves the upper lift arm and this motion is transferred to the upper hinge point 118 by a linkage system. This causes the bucket to rotate about the lower hinge point. It has been discovered over time, that the upper hinge point experiences a great deal of cyclic stress as loading and unloading the bucket takes place. As can be imagined, a variety of bucket hinge designs have been developed to provide the necessary movement and endure the repeated stress necessary for this type of machine interface.

However, it has been found that previous designs are heavier than desirable and create additional problems. They often have welded brackets and gussets to strengthen the hinge but this adds significant bucket weight. The increased weight may lead to high stresses that may cause problems with the buckets that necessitate repair or replacement. The increased weight may also lead to machine downtime and fuel inefficiency. Tire life and machine stability may also be adversely affected.

For all the above reasons, it is desirable to develop a lighter and more durable bucket that uses lower and upper hinge points than has been previously devised.

SUMMARY OF THE DISCLOSURE

A work implement for use with a machine is provided that includes a body that is configured to perform work and that includes a wall that has a hinge attachment bracket attached thereto. The bracket may comprise a substantial I-beam configuration that includes a first flange, a second flange, a web that connects the first flange to the second flange and that defines a boss that defines a pin receiving bore that establishes a radial direction, a radial plane and a longitudinal axis. The first and second flanges may merge toward each other tangentially forming a first extension portion.

A hinge attachment bracket for use with a work implement is provided. The bracket may comprise a substantial I-beam configuration that includes a first flange, a second flange, a web that connects the first flange to the second flange and that defines a boss that defines a pin receiving bore that establishes a radial direction, a radial plane and a longitudinal axis. The first and second flanges may merge toward each other tangentially forming a first extension portion.

A machine that comprises a motor, a frame, at least two lift arms that are configured to be attached to work implement using upper and lower hinge point is provided. The work implement may be configured to perform work and may include a wall that has a plurality of hinge attachment brackets attached thereto. At least one hinge attachment bracket may comprise a substantial I-beam configuration that includes a first flange, a second flange, a web that connects the first flange to the second flange and that defines a boss that defines a pin receiving bore that establishes a radial direction, a radial plane and a longitudinal axis. The first and second flanges may merge toward each other tangentially forming a first extension portion.

DETAILED DESCRIPTION

Figure 1:
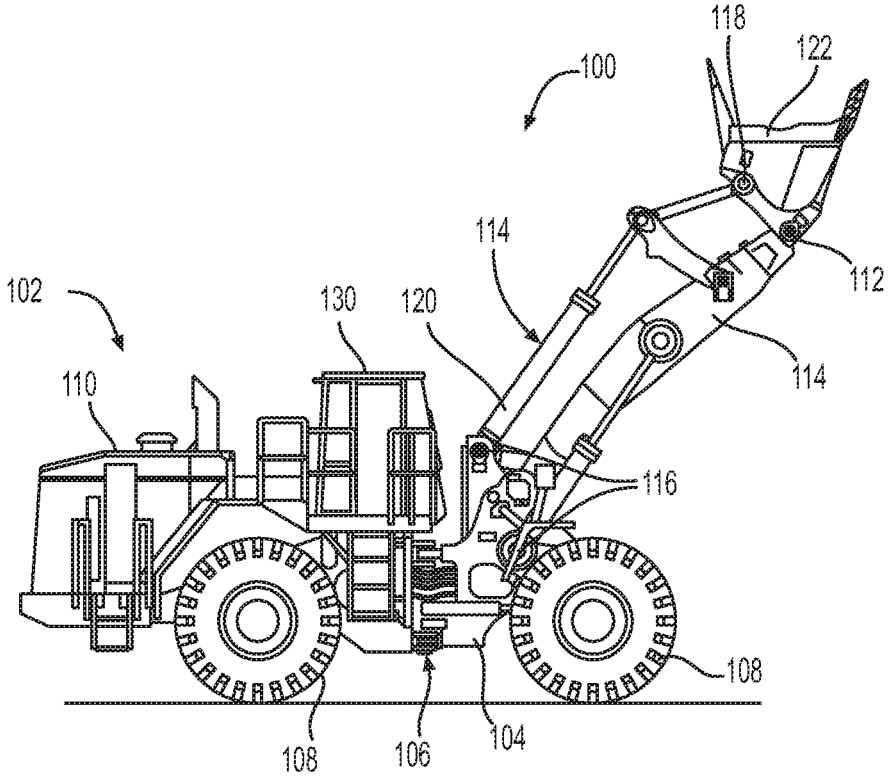
FIG. 1 (PRIOR ART)
FIG. 1 is a side view of a machine in the form of a wheel loader that interfaces with a bucket using upper and lower hinge points as is known in the art.
Figure 2:
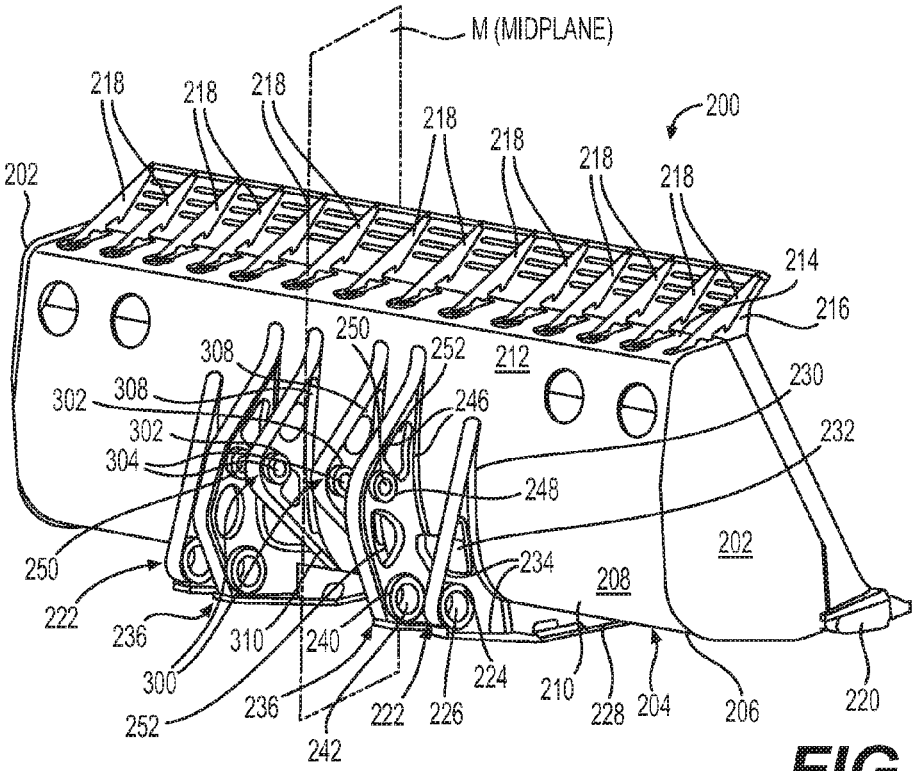
FIG. 2 is a back perspective view of a bucket that uses an upper hinge design according to an embodiment of the present disclosure.

Focusing now on FIG. 2, an embodiment of bucket 200 that uses an upper hinge design according to one embodiment of the present disclosure is shown. The bucket 200 in general has a standard configuration so a detailed explanation of its various parts is not warranted. It has some features that are commonly used in buckets. In general terms, the bucket 200 includes first and second end walls 202 and a shell 204 that extends between the end walls 202. The shell includes a bottom wall portion 206, a rear wall portion 208, and curved transition portion 210 that connects the rear wall portion 208 to the bottom wall portion 206. A torsion tube 212 is attached to the top of the shell 204 that extends between the end walls 202. As viewed in FIG. 2, the torsion tube 212 forms a continuation of the rear wall 208 that transitions into a top plate 214. The torsion tube 212 also forms reinforcing structure located toward the interior of the bucket that will be shown more clearly later herein.

A spill guard 216 is attached to the top plate 214 that is angled slightly up from the top plate 214. Reinforcing plates 218 are spaced laterally along the bucket that connect the spill guard 216 to the top plate 214, strengthening the connection between the spill guard 216 and the top plate 214. Cutting edge support 220 can also be seen that is attached proximate the front lip of the bucket.

The hinge attachment brackets that form the upper and lower hinge structures will now be discussed. First, there are two outside hinge attachment brackets 222 of similar construction that form part of the lower hinge structure. The outside attachment bracket 222 includes boss 224 that defines a pin receiving bore 226 and lower attachment structure 228 that attaches the bracket to the bottom of the bucket. The upper attachment structure 230 of the outside attachment bracket 222 comprises an I-beam configured span that gradually transitions or bleeds into the rear wall 208 and the back portion of the torsion tube 212. An aperture 232 is present between the boss 224 and the flanges 234 that merge near the rear wall 208. This reduces the weight of the hinge attachment bracket.

Second, there are two intermediate hinge attachment brackets 236 that form part of the upper and lower hinge structures that are also similarly configured. The lower attachment structure 238 of the intermediate bracket 236 is constructed similarly to that of the outside attachment bracket and its boss 240 also forms a pin receiving bore 242 that is in alignment with the pin receiving bore 226 of the outside attachment bracket. Also, its upper attachment structure 244 includes an I-beam configured span as well. However, the flanges 246 of this span do not merge into the rear wall but remain substantially equidistant from each other until another boss 248 is formed that defines another pin receiving bore 250 that is part of the upper hinge structure. The flanges 246 begin to merge above the second boss 248 and transition or bleed into the rear wall 208 and torsion tube 212. Two apertures 252 are provided, one between the bosses and one between the upper boss and the merging of the flanges. These apertures also reduce the weight of these attachment brackets.

Figure 3:
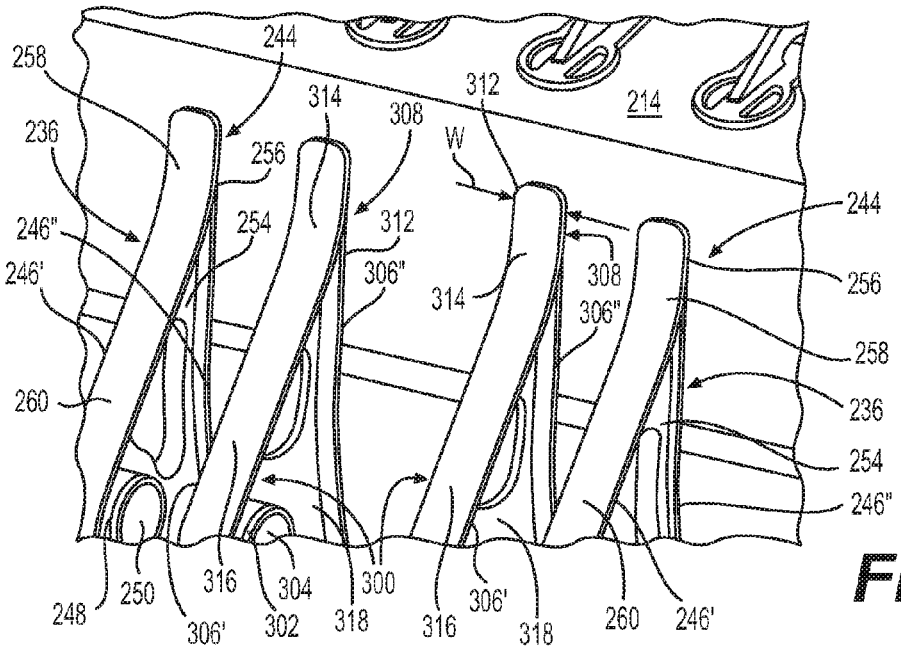
FIG. 3 is an enlarged detail view showing the upper attachment of a bracket that uses the upper hinge design of FIG. 2 with more clarity.

Third, the inside hinge attachment brackets 300 are shown whose entire configuration is substantially shaped like an I-beam and are similarly configured. The inside attachment bracket includes a boss 302 that defines a pin receiving bore 304 that is aligned with the upper bore 250 of the intermediate bracket, establishing the upper hinge. As best seen in FIG. 3, the flanges 306', 306" of the inside hinge attachment bracket 300 are furthest away from each other proximate the boss 302 and then continue to merge toward each other in both the upper and lower directions where they meet and bleed or transition into the rear wall 208 and rear portion of the torsion tube 212 for the upper attachment structure 308 and the rear wall 208 and transition portion 210 of the shell 204 for the lower attachment structure 310.

For this embodiment though not shown explicitly, two pins are used for the upper hinges to connect to two upper lift arms and two pins are used for the lower hinges to connect to two lower lift arms. It is contemplated that the number of pins and connections may vary as desired. There will usually be at least one attachment bracket for an upper hinge and at least one attachment bracket for the lower hinge. The entire bucket and its attachment brackets are mirrored about its midplane M.

All of the various components of the bucket may be attached to each other using any suitable method or device known in the art including welding by way of an example. The attachment brackets may be manufactured using a casting process or may be assembled using structural steel plates, etc.

Looking now at FIG. 3, the upper attachment structures 244, 308 of the intermediate and inside attachment brackets 236, 300 may be seen more precisely. It is these brackets that form the upper hinge for the bucket and they have similar configurations for their upper attachment structures. Specifically, their upper attachment structures all have substantial I-beam configurations that include a web 254, 318 that connects an outside flange 246', 306' to an inside flange 246", 306" and that forms a boss 248, 302 that defines a pin receiving bore 250, 304. The outside flange 246', 306' angles toward the inside flange 246", 306" where they merge and form an extension portion 256, 312 on the rear portion of the torsion tube 212. This extension may be thinner than the flanges. Hence, this extension may be considered to be thin. A generous blend 258, 314 is provided on the outside flange that smooths the transition from the straight portion 260, 316 of the outside flange to the thin extension portion 256, 312 of the bracket.

Figure 4:
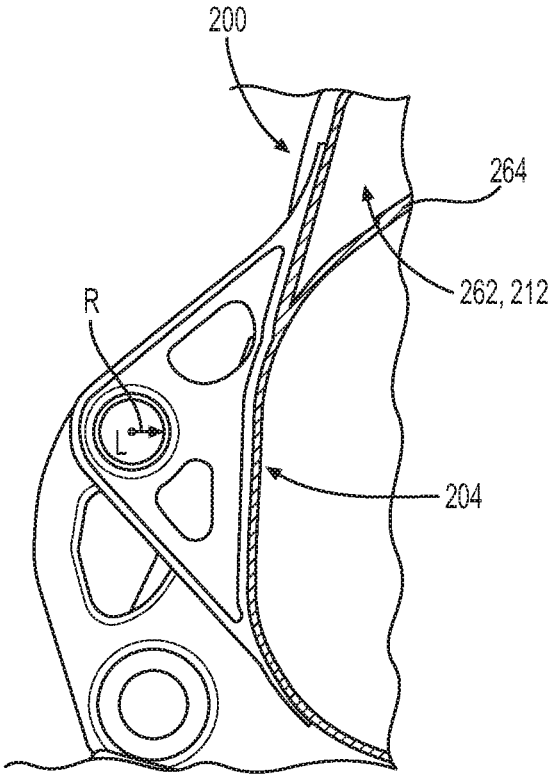
FIG. 4 is a side sectional view of the bucket of FIG. 3 taken along a midplane of that bucket, showing the details of the bracket.
Figure 5:
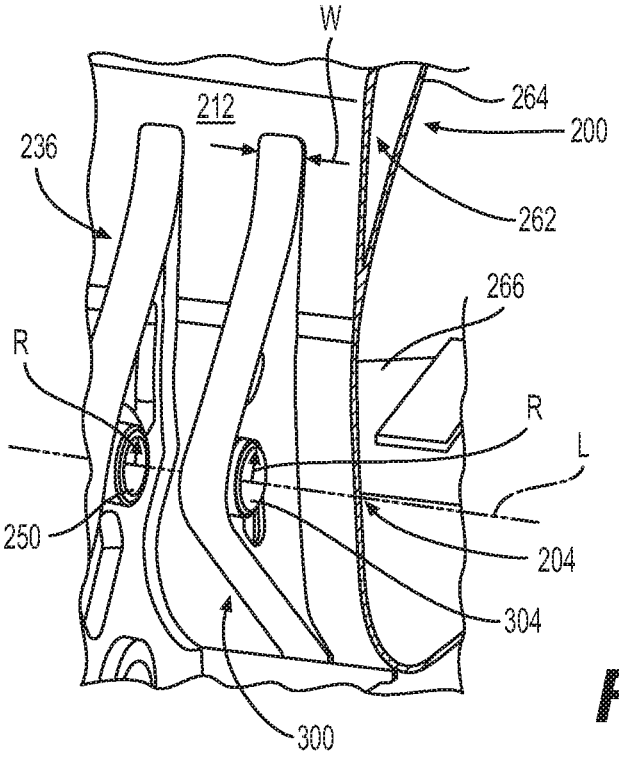
FIG. 5 is a perspective view of the bucket of FIG. 4.

Focusing now on FIGS. 4 and 5, the bucket of FIGS. 2 and 3 is shown cut in half along the midplane of the bucket. This reveals some of the internal structure of the bucket 200 including the tubular structure 262 of the torsion tube 212 that helps prevent the twisting of the bucket about an axis that is parallel to the axis of rotation L of the hinge. A portion 264 of the shell 204 that forms the interior space of the bucket can be seen that angles away from its rear wall portion and eventually meets up with a top plate (not shown here). Also, the lower lip 266 of the bucket can be seen in FIG. 5. FIG. 5 illustrates one inside hinge attachment bracket 300 and one intermediate bracket 236 that have pin receiving bores 250, 304 that receive the same pin, forming one working upper hinge for the bucket. The pin receiving bores establish a radial direction R and longitudinal axis L.

Figure 6:
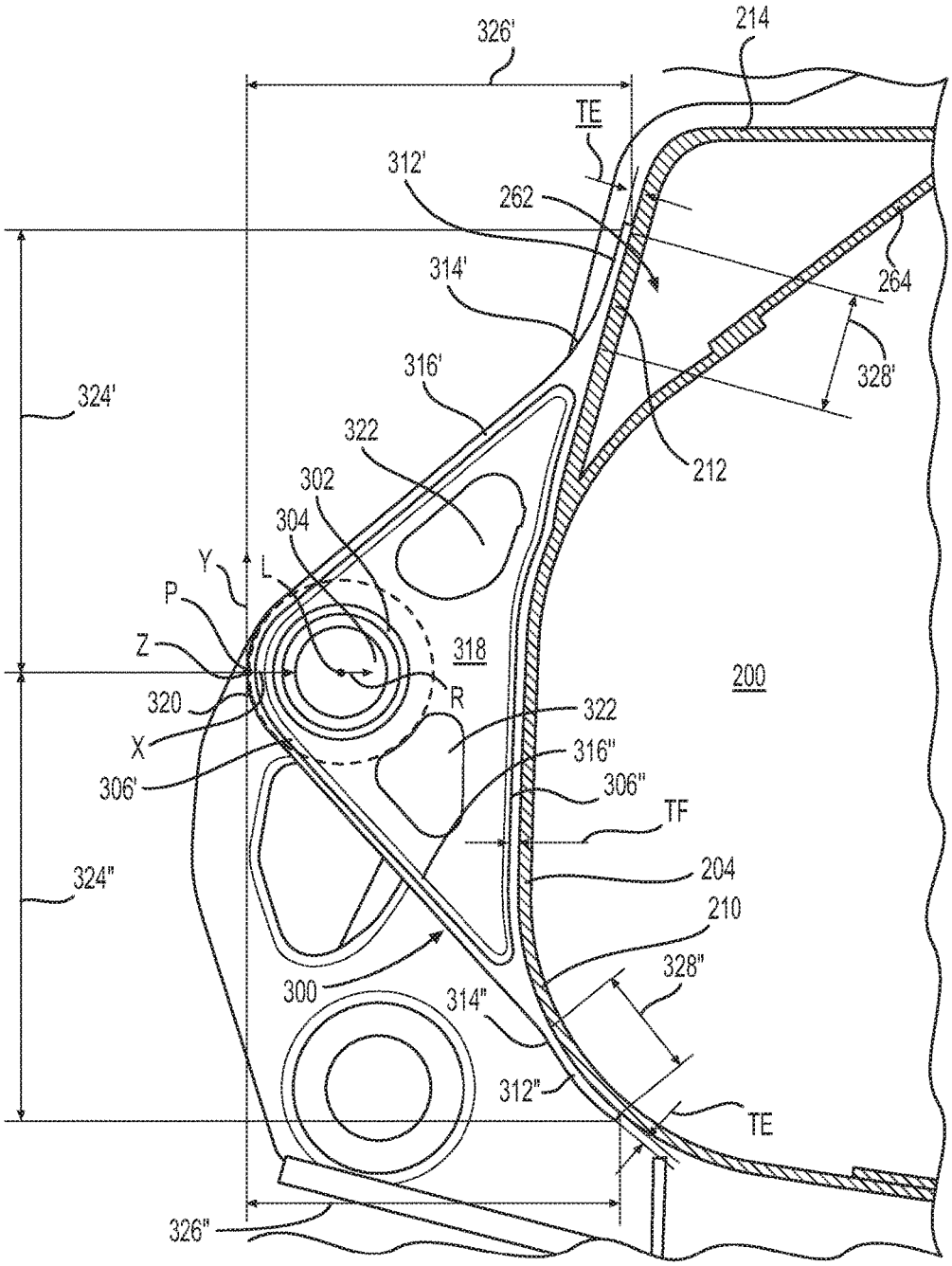
FIG. 6 is an enlarged side sectional view of the bucket of FIG. 4, showing some of the dimensions and details of the upper hinge design more clearly.

FIG. 6 is an enlarged side sectional view of the bucket 200 of FIG. 4, showing some of the dimensions and details of the upper hinge design more clearly. The focus of FIG. 6 is the inside hinge attachment bracket. The inside hinge attachment bracket 300 is substantially I-beam configured with a web 318, an inside flange 306" that is proximate the profile of the shell 204 and torsion tube 212, and an outside flange 306' that defines the portion of the attachment bracket that is furthest away from the bucket. The web 318 connects the outside flange to the inside flange and defines a boss 302 that defines the pin receiving bore 304.

The outside flange 306' includes an upper straight portion 316', a lower straight portion 316" and a transition portion 320 that connects the straight portions together. The curvature of the transition portion 320 is concentric with the curvature of the boss 302 that defines the pin receiving bore 304. The transition or curved portion defines a point P of tangency that is located at a radial extremity of the hinge attachment bracket 300. A Cartesian coordinate system is defined by the bracket 300 with its origin being at the point P of tangency with its X axis aligned with the radial direction R and its Z axis parallel with the longitudinal axis L of the bore. The straight portions 316', 316" of the outside flange 306' form an angle that is slightly less than ninety degrees and extend to points where they begin to merge with the inside flange 306" near the upper and lower extension portions 312', 312" of the bracket. Each straight portion forms an angle of about 40 to 47 degrees from the X axis. The two apertures 322, which are thru-holes, can also be seen for decreasing the weight of the attachment bracket. The configuration of the inside attachment bracket including its various angles may be adjusted depending on the application.

The web 318 extends in a plane that is substantially parallel with the X-Y plane and the flanges extend in the Z direction defining a width. The web has a thickness in the Z direction that may vary from 15 mm to 60 mm but may be adjusted depending on the application. The width W of the flange, best seen in FIGS. 3 and 5 is the minimum distance of the flange 306 or extension portion 312 in the Z direction while the thickness TF of the flange is the minimum dimension of the flange in the X-Y plane as best seen in FIG. 6. The thickness of the flanges may vary from 15 mm to 60 mm but may be adjusted depending on the application.

A generous upper blend 314' and lower blend 314" is present near this merging on the outside surface flange. It is contemplated that for other embodiments, either flange may define a curve that is tangent to the other flange that defines a minimum radius of curvature to help provide a smooth transition or merging of the flanges toward each other for forming an extension portion 312.

For this embodiment, a radius of 500 mm is provided for both blends but this may be adjusted depending on the application. In most embodiments, this radius is at least 250 mm. Also, other transitional geometry other than a pure radius may be provided as long as a radius of curvature of a minimum size is maintained. As mentioned previously, the Cartesian coordinate system is positioned at a point P of the transitional region 320 of the outside flange that is vertically aligned with the center of the bore 304. Consequently, the Y axis is tangent to the curvature of the transitional region 320.

The upper height 324' of the inside hinge attachment bracket 300 is shown as being measured from the origin of the coordinate system to the vertical extremity of the bracket in the positive Y direction. Similarly, the lower height 324" of the attachment bracket is shown as being measured from the origin of the coordinate system to the vertical extremity of the bracket in the negative Y direction. In some embodiments, the upper and lower height dimensions may vary but may range from 900 to 1000 mm and may be between 940 and 950 mm.

Similarly, the upper depth 326' of the attachment bracket is shown as being measured from the point of origin to the horizontal extremity of the upper extension 312' of the attachment bracket in the positive X direction and the lower depth 326" of the attachment bracket is shown as being measured from the point of origin of the coordinate system to the horizontal extremity of the lower extension 312" of the attachment bracket in the positive X direction. In some embodiments, the upper and lower depth dimensions may vary but may range from 750 to 850 mm and may be between 790 and 820 mm.

The inside and outside flanges 306", 306' merge tangentially to form an upper extension 312' and a lower extension 312". The upper extension also defines a thickness TE that is the minimum distance of this extension in the X-Y plane. Likewise, the lower extension defines a thickness TE that is the minimum distance of the extension in the X-Y plane. The thickness of the extensions in this embodiment may vary as desired but are often less than the thickness of the web or the flanges and in this embodiment are about 20 mm but they may vary from each other. The upper extension 312' also defines a length 328' that is measured from a point where the local thickness is no greater than the thickness of the flange in the X-Y plane to its outer extremity. Similarly the lower extension 312" also defines a length 328" that is measured in like fashion. In both cases, the distance is the minimum distance in the X-Y plane between these points.

For this embodiment, the upper extension 312' is substantially straight along the straight rear wall portion of the torsion tube 212. The lower extension 312" is slightly curved matching the curvature of the transition region 210 of the shell 204. The lengths of both extensions may change depending on the application but for this embodiment they typically range from 200 to 300 mm, or more specifically, from 230 to 260 mm. In some embodiments, the length of the upper extension may be about 250 mm and the length of the lower extension may be about 237 mm.

The inventor performed a FEA study so see what effect the ratios of these various dimensions had on the durability of the new design for the upper hinge. Table 1 below shows the recommended ranges of these ratios to obtain the desired benefits of reduced weight or, in some circumstances, increased longevity of the upper hinge.

TABLE 1

| Ratio of Dimensions | Range | Reference No. in FIGS. |
|---|---|---|
| Upper Height/Length of Extension of Upper Attachment | 2.5-7.5 | 324'/328' |
| Lower Height/Length of Extension of Lower Attachment | 2.5-7.5 | 324"/328" |
| Length of Extension of Upper Attachment/ Thickness of Upper Extension | 5-15 | 328'/TE |
| Length of Extension of Lower Attachment/ Thickness of Lower Extension | 5-15 | 328"/TE |
| Upper radius of curvature/Length of Extension of Upper Attachment | 1-3 | 314'/328' |
| Upper radius of curvature/Length of Extension of Lower Attachment | 1-3 | 314'/328" |
| Upper Height/Width of Flange | 4-10 | 324'/W |
| Lower Height/Width of Flange | 4-10 | 324"/W |
| Width of Flange/Extension Thickness (upper or lower) | 4-11 | W/TE |

Figure 7:
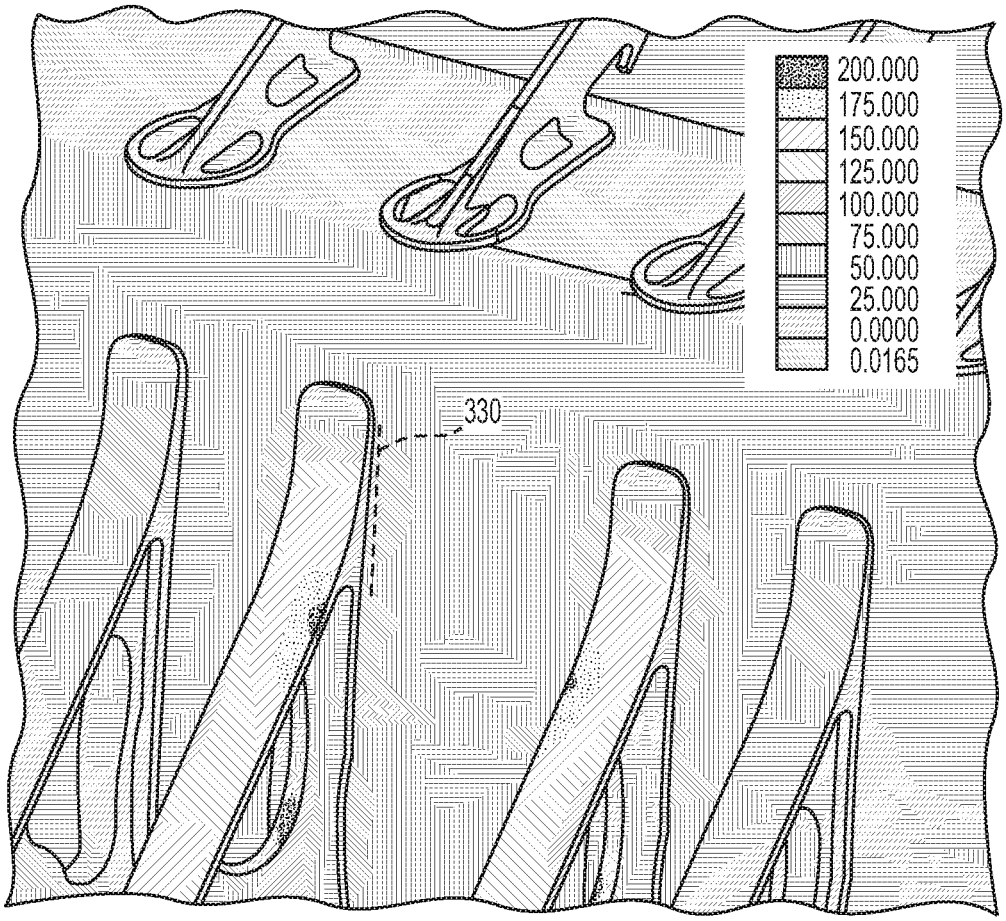
FIG. 7 is a stress plot created using FEA of the bucket of FIG. 3 showing the reduced stresses provided by the new upper hinge design where the bracket is welded to the bucket.

FIG. 7 is a stress plot created using FEA of the bucket of FIG. 3 showing the reduced stresses provided by the new upper hinge design where the bracket is welded to the bucket. In the past, the weld seam, designated by dotted lines 330, was where the highest stress occurred. This was undesirable as this became a weakness of the welded joint and resulted in repair or replacement of the bucket. Now, the highest stress is in the flange, which is desirable as it is designed to take high stress. This means that the new upper hinge design is more reliable than previous designs. It should be noted that the inside attachment brackets experience the most stress of all the attachment brackets but it is contemplated that any of the attachment brackets can benefit from the new upper hinge design.

INDUSTRIAL APPLICABILITY

In practice, the hinge attachment bracket with the improved design may be used to retrofit an existing bucket or other work implement that may be used with any machine that has an interface with the work implement. Consequently, it may be sold separately from any machine or work implement. While the embodiments specifically discussed herein are used with upper and lower hinge connections to a machine, the principles of the new hinge design may be used for any type of hinge connection.

More specifically, the improved hinge design may be used with any work implement that includes a body that is configured to perform work such as manipulating or moving a work material. The work implement would also include a wall for attaching the hinge attachment bracket.

Referring back to FIG. 6, the upper hinge design may include a hinge attachment bracket 300 that comprises a substantially I-beam configuration including a first flange 306', a second flange 306", and a web 318 that connects the flanges together. The web may further define a boss 302 that defines a pin receiving bore 304 that establishes a radial direction R and a longitudinal direction L. The web may extend in the radial plane R and the flanges may extend along the longitudinal direction L. The first flange may be considered an inside flange as its function is to match or conform to the majority of the profile of a wall of the work implement and is to be adhered to that wall in a flush manner. Adherence may be achieved using welding or other methods and devices in the art. The second flange may be considered an outside flange at its function is primarily to provide strength and rigidity to the attachment bracket.

The attachment bracket may form at least one extension portion. The extension may be formed by the merging of the flanges toward each other in a tangential manner. In some cases, this tangential merging is achieved by providing a curve having a predetermined minimum radius of curvature. In some embodiments, the curve may be a precise radius but may be other curvilinear shapes or curves. In still further embodiments, the attachment bracket may have two extension portions that are formed by the merging of the flanges toward each other in a tangential manner. The tangential merging of the second extension may also be achieved by providing a curve having a predetermined minimum radius of curvature and the curve may also be a precise radius.

When two extensions are present, one may be referred to as an upper extension and the other may be referred to as a lower extension and the extensions may extend primarily in directions that are in the radial plane of the pin receiving bore, which is also the X-Y plane as mentioned previously herein.

A machine that uses a work implement that has a hinge attachment bracket as described herein may weigh less and have better stability. Also, the durability of the hinge design may increase the life of the bucket resulting in less machine downtime and maintenance costs.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. Also, the numericals recited are also part of the range.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A work implement for use with a machine, the work implement comprising:

a body that is configured to perform work and that includes a wall; and a hinge attachment bracket that is attached to the wall and that comprises:

a substantial I-beam configuration that includes a first flange, a second flange, a web that connects the first flange to the second flange and that defines a boss that defines a pin receiving bore that establishes a radial direction and a longitudinal axis, wherein:

the first and second flanges merge toward each other tangentially forming a first extension portion.

2. The work implement of claim 1 wherein the first or second flange defines a curve that is tangent to either flange, wherein the curve defines a minimum radius of curvature.

3. The work implement of claim 2 wherein the curve is a radius.

4. The work implement of claim 3, wherein the radius has a value of at least 250 mm.

5. The work implement of claim 1, wherein the second flange includes a curved portion that is configured to be concentrically arranged about a portion of the boss, the curved portion defining a point of tangency that is located at a radial extremity of the hinge attachment bracket; and wherein a Cartesian coordinate system is defined by the bracket, the Cartesian coordinate system defining an origin, an X axis, an Y axis, a Z axis, and an X-Y plane, the origin of the Cartesian coordinate system being at the point of tangency with the X axis of the Cartesian coordinate system aligned with the radial direction and the Z axis parallel with the longitudinal axis of the bore.

6. The work implement of claim 5, wherein the first extension portion defines an extremity of the bracket and a dimension measured from the origin of Cartesian coordinate system to the extremity along the Y axis, the first extension portion further defining a length in the X-Y plane, wherein a ratio of the dimension measured along the Y axis divided by the length ranges from 2.5 to 7.5.

7. The work implement of claim 5 wherein the first extension portion defines a length in the X-Y plane and a thickness which is the minimal dimension of the extension in the X-Y plane, wherein a ratio of the length divided by the thickness ranges from 5 to 15.

8. The work implement of claim 5 wherein the first or second flange defines a curve that is tangent to either flange, wherein the curve defines a minimum radius of curvature having a value and the extension defines a length in the X-Y plane, wherein a ratio of the length divided by the value of the radius of curvature ranges from 1 to 3.

9. The work implement of claim 5 wherein the first extension portion defines an extremity of the bracket and a dimension along the Y axis measured from the origin of Cartesian coordinate system to the extremity and a width in the Z axis, wherein a ratio of the dimension along the Y axis divided by the width ranges from 4 to 10.

10. The work implement of claim 5 wherein the first extension portion defines a thickness in the X-Y plane and a width in the Z axis, wherein a ratio of the width divided by the thickness ranges from 4 to 11.

11. The work implement of claim 1 wherein the first extension portion is an upper extension portion.

12. The work implement of claim 1 wherein the hinge attachment bracket is an inside hinge attachment bracket.

13. The work implement of claim 1 wherein the body of the work implement forms a bucket.

14. The work implement of claim 13 wherein the bucket comprises first and second end walls, a shell that extends between the end walls, and a torsion tube that is attached to the shell and extends between the end walls.

15. A hinge attachment bracket for use with a work implement comprising:

a substantial I-beam configuration that includes a first flange, a second flange, a web that connects the first flange to the second flange and that defines a boss that defines a pin receiving bore that establishes a radial direction, a radial plane and a longitudinal axis, wherein:

the first and second flanges merge toward each other tangentially forming a first extension portion.

16. The hinge attachment bracket of claim 15 wherein the first and second flanges merge toward each other a second time forming a second extension portion.

17. The hinge attachment bracket of claim 16 wherein the first flange and second flanges each define a thickness in the radial plane and the first extension and second extension portions each define a thickness in the radial plane, and the thickness of either extension portion is less than the thickness of the flanges.

18. A machine comprising:

a motor;

a frame;

a work implement;

at least two lift arms that are configured to be attached to the work implement using upper and lower hinge points; and the work implement comprising:

a body that is configured to perform work and that includes a wall; and a plurality of hinge attachment brackets attached to the wall that provide upper and lower hinge points wherein at least one hinge attachment bracket comprises:

a substantial I-beam configuration that includes a first flange, a second flange, a web that connects the first flange to the second flange and that defines a boss that defines a pin receiving bore, wherein:

the first and second flanges merge toward each other tangentially forming a first extension portion.

19. The machine of claim 18 further comprising wheels.

20. The machine of claim 18 wherein the work implement includes a bucket.

* * * * *